United States Patent [19]

Rausch et al.

[11] 4,263,127

[45] Apr. 21, 1981

[54] WHITE OIL PROCESS

[75] Inventors: Maurice K. Rausch, South Holland; Daniel B. Eickemeyer, Crete; Gerald E. Tollefsen, Calumet City, all of Ill.

[73] Assignee: Atlantic Richfield Company, Philadelphia, Pa.

[21] Appl. No.: 110,432

[22] Filed: Jan. 7, 1980

[51] Int. Cl.[3] ..... C10G 65/02; C10G 47/12

[52] U.S. Cl. ..... 208/58; 208/18; 208/57

[58] Field of Search ..... 208/58, 57, 18

[56] References Cited

U.S. PATENT DOCUMENTS

| | | | |
|---|---|---|---|
| 3,459,656 | 8/1969 | Rausch | 208/57 |
| 3,629,096 | 12/1971 | Divijak | 208/89 |
| 3,642,610 | 2/1972 | Divijak et al. | 208/58 |
| 3,852,207 | 12/1974 | Stangeland et al. | 208/58 |
| 3,926,777 | 12/1975 | Menzl | 208/57 |
| 4,183,801 | 1/1980 | Breuker et al. | 208/59 |

*Primary Examiner*—Herbert Levine
*Assistant Examiner*—G. E. Schmitkons
*Attorney, Agent, or Firm*—Frank J. Uxa

[57] ABSTRACT

The preparation of food grade white mineral oils of suitable viscosity in high yield from a mineral oil distillate of suitable lubricating oil viscosity comprises contacting the distillate with hydrogen in three catalytic stages to yield a refined lubricating oil from which white mineral oil is recovered. The first reaction stage employs hydrocracking conditions. Subsequent reaction stages employ hydrogenation conditions, first with a sulfur-resistant hydrogenation catalyst and finally with a platinum group metal-containing selective hydrogenation catalyst, optionally activated with a halogen.

28 Claims, No Drawings

WHITE OIL PROCESS

This invention relates to a convenient and economic process for the production of white mineral oil, especially food grade white oil, preferably having a suitably high viscosity; for example, from about 50 to above about 500 SUS at 100° F. More particularly, this invention relates to a three-stage catalytic process for conveniently producing food grade white mineral oil of high quality and in high yields.

Various prior art processes have been developed for the hydrogen processing of various hydrocarbon feedstocks not usually suitable for the production of high quality lubricating oils. Additionally, hydrogen processing has been found to be greatly preferred over the acid treating and solvent extraction techniques formerly employed with conventional white oil base stocks. Both improved quality and improved yields are generally realized.

For example, U.S. Pat. No. 3,642,610 relates to a two-stage hydrocracking and hydrotreating process for the production of lubricating oils from not only lubricating oil distillates but also from such generally undesirable stocks as deasphalted residual oils, high-sulfur and high-nitrogen heavy oils, sour oils, and other contaminated stocks. Such processing may lead to a finished lubricating oil, having a viscosity index of about 95, in yields of about 60 vol. %, based on raw stock. More severe processing leads to a finished product having a lower viscosity but a higher viscosity index in the range of about 120 in yields of about 40 vol. %.

U.S. Pat. No. 3,459,656 relates to a two-stage hydrotreating process for the production of technical grade or food grade white mineral oils from good quality naphthenic base oils. The second hydrotreating stage employs a promoted platinum group metal catalyst. Finished technical grade white oils are obtained in yields of about 90 vol. % or more. More severe processing is required for production of food grade white oils.

It is an object of this invention to provide a convenient and economical process for the production of high quality food grade white mineral oil from mineral oil distillates of suitable lubricating oil viscosity.

It is another object of this invention to produce such food grade white mineral oil in high yield from available base stocks.

It is a further object of this invention to provide a suitable food grade white oil having a viscosity index of at least about 100 and especially including white oils having a viscosity greater than about 500 SUS at 100° F. Other objects and advantages of the present invention will become apparent hereinafter.

In one embodiment, the process of this invention comprises the steps of:

(a) contacting the mineral hydrocarbon oil feedstock with molecular hydrogen under hydrocracking conditions, in the presence of a hydrocracking catalyst to form a hydrocracked oil having increased viscosity index relative to the feedstock;

(b) contacting the hydrocracked oil of lubricating oil viscosity from step (a) with molecular hydrogen under hydrogenation conditions in the presence of a hydrogenation catalyst to form a hydrocarbon oil having a reduced concentration of sulfur relative to the hydrocracking oil; and (c) contacting the hydrocarbon oil of lubricating oil viscosity from step (b) with molecular hydrogen under selective hydrogenation conditions in the presence of a selective hydrogenation catalyst.

Preferred catalysts for the hydrocracking step are selected from one or more Group VI-B metals and/or iron-group metals of Group VIII, for example present as in the metal, oxide or sulfide, on an inorganic oxide support, e.g., alumina, together with silica-alumina and/or boria.

Similarly, preferred catalysts for the hydrogenation step are selected from one or more Group VI-B metals and/or iron-group metals of Group VIII, for example, present as the metal, oxide or sulfide, on an inorganic oxide support, e.g., alumina.

Additionally, preferred catalysts for the selective hydrogenation step are selected from one or more of the platinum group metals of Group VIII on an inorganic oxide support, e.g., alumina, and, optionally, a halogen component.

The mineral lubricating oils treated by the process of the present invention are of lubricating viscosity and preferably are stocks having at least about 90 weight % boiling above about 600° F. The feeds are preferably oils having a viscosity index of at least about 10, e.g., about 10 to 80, and can be derived from paraffinic or mixed base crude oils. The total or full range oil of lubricating viscosity obtained by the method of the present invention preferably has a viscosity index in the range of at least about 80, more preferably at least about 100, (on a dewaxed basis) with the increase in the viscosity index of the product being at least about 20, preferably at least about 30, over that of the feed. Both the initial hydrocarbon feedstock and the product of lubricating viscosity from the selective hydrogenation reaction zone may boil over a considerable temperature range, e.g., over a range of at least about 100° F., often at least about 200° F. The method of the present invention is particularly suitable for treating highly contaminated stocks, containing larger amounts of aromatics and frequently have been subjected only to fractionation. Thus the present method can utilize these economically cheaper feedstocks to produce high quality oils in high yields.

Hydrocracking of the feedstock, which includes ring opening and usually desulfurization and denitrogenation, may be carried out in the presence of any catalyst system possessing hydrocracking activity relative to lubricating oil range hydrocarbons. However, it is preferred to employ a catalyst containing at least one Group VIII iron-group metals, such as nickel and/or cobalt, and/or at least one Group VI-b metal, such as one or both of molybdenum or tungsten, supported on a catalytically active support, preferably comprising boria and/or silica alumina together with alumina. The metals of the catalyst may be present in the form of free metals or in combined form such as the oxides and sulfides, the sulfides being the preferred form. Examples of such mixtures or compounds are nickel oxide or sulfide with molybdenum or tungsten as the corresponding oxide or sulfide. These catalytic ingredients are employed while disposed on a support which preferably includes silica-alumina and/or boria and a catalytically active alumina. The catalyst is preferably comprised of minor, catalytically effective amounts of nickel, tungsten and/or molybdenum and boria and/or silica-alumina with the alumina base. The Group VIII iron group metal, e.g., nickel, preferably comprises about 1–15 weight % of the catalyst, more preferably about 2–10%, with the total amount of Group VI-B metal, e.g., tungsten and molybdenum, preferably being about 5–30 weight %, more preferably about 10–30%, of the hydrocracking catalyst on a metal oxide basis.

When boria is present, it is preferably present in an amount of about 2 to 10 weight %, based on the total weight of the catalyst while the alumina is the major component of the catalyst, e.g., essentially the balance of the support composition. Of course, other components may be included in the catalysts useful in the present process, provided that such components do not unduly and deleteriously affect the functioning of the catalysts.

One catalyst composition useful in the hydrocracking stage of the present invention can be prepared by adding the Group VIII iron group metal, Group VI-B metal and boria components to an alumina base by various methods known to the art, for example, by impregnation or precipitation or coprecipitation using suitable compounds of the metals and boron. For example, alumina particles containing boria or a material which upon heating yields boria, can be mixed with aqueous ammonia solutions containing nickel and tungsten, and/or molybdenum, or other aqueous solutions of water-soluble compounds or nickel and tungsten and/or molybdenum, so that the metal compounds are absorbed on the base. Alternatively, the promoting materials can be precipitated on the boria-containing alumina base through suitable reaction of an aqueous slurry of the support containing water-insoluble salts of the promoting metals. The boria-containing particles can be formed into macrosize either before or after being mixed with the Group VIII iron group metal and Group VI-B metal components. The catalyst can be dried and calcined, e.g., at temperatures of about 800° to 1,200° F., or somewhat more. Prior to use, the catalyst is preferably sulfided at elevated temperature.

A second catalyst composition useful in the hydrocracking stage of the present invention includes a support which contains a total of about 30% to about 70% by weight of silica and about 70% to about 30% by weight of alumina, preferably about 35% to about 65% by weight of silica and about 65% to about 35% by weight of alumina. This support is a composite formed by the combination of about 40% to about 90%, preferably about 40% to about 85%, by weight of amorphous silica-alumina and about 10% to about 60%, preferably about 15% to about 60% by weight of alumina derived from hydrous alumina selected from the group consisting of boehmite, amorphous hydrous alumina and mixtures thereof, preferably boehmite and mixtures of boehmite and amorphous hydrous alumina. The amorphous silica-alumina component of the catalyst may be available in the form of relatively finely divided particles, e.g., of a particle size of up to about 65 microns, and contain about 40% to about 92% by weight of silica and about 8% to about 60% by weight of alumina. Commercially available silica-alumina hydrocarbon cracking catalyst particles can be used in making such a catalyst used in step (1) of this invention and, in one instance, can contain 87% weight percent silica and 13% weight percent alumina.

The silica-alumina component of this second catalyst useful in the hydrocracking step of the present invention may also be prepared by conventional methods similar to those methods known to the art for the production of synthetic silica-alumina cracking catalyst. Such preparations may involve forming a silica hydrogel by the precipitation of an alkali metal silicate solution with an acid such as sulfuric acid. Alumina is then precipitated by adding an alum solution to the silica hydrogel slurry and raising the pH into the alkaline range by the addition of sodium aluminate solution or by the addition of a base such as ammonium hydroxide. These conventional methods for producing silica-alumina also include co-precipitation techniques wherein the acid-acting alum solution is added to the silicate solution to precipitate both silica and alumina simultaneously perhaps with a pH adjustment for further precipitation. Also, a constant pH technique whereby the solutions of each oxide component are added continuously to a mixing vessel may be employed. In any event, the alumina is precipitated in the presence of silica to form what may be referred to as coherent aggregates of silica-alumina. Although the silica-alumina component of this second hydrocracking catalyst may have a wide range of surface areas, for example, about 50 m./$^2$gm. to about 500 m.$^2$/gm. or more, it is preferred that the silica-alumina have a surface area of at least about 300 m.$^2$/gm. The surface areas referred to herein are as determined by the BET nitrogen adsorption procedure (JACS, vol. 60, pp. 309 et seq., 1398).

The added alumina content of this hydrocracking catalyst support useful in the present invention is obtained by combining alumina as hydrous alumina with the silica-alumina which may be, at the time of hydrous alumina addition, in any stage of manufacture, from the original crude hydrogel as precipitated and separated from the aqueous supernatant liquid to the completely finished silica-alumina product in either dried or calcined form.

The present silica-alumina, alumina-containing hydrocracking catalyst support may be prepared by precipitation of hydrous alumina in the presence of the silica-alumina at a pH of about 5 to about 9, or the alumina hydrogel may be prepared separately. In either case, the preparation is such as to produce a support having added alumina in the form derived from hydrous alumina selected from the group consisting of boehmite, amorphous hydrous alumina and mixtures thereof, preferably from the group consisting of boehmite and mixtures of boehmite and amorphous hydrous alumina. The term "boehmite" or "boehmite alumina" includes both well crystallized boehmite and poorly crystallized boehmite, sometimes called pseudoboehmite. Preferably, the boehmite alumina has a crystallite size of up to about 50 A. As determined by X-ray diffraction on samples dried to 110° C. When mixtures of boehmite and amorphous hydrous alumina are used, the boehmite preferably comprises about 45% to about 85% by weight of the mixture and the amorphous hydrous alumina comprises about 15% to about 55% by weight of the mixture.

The hydrous alumina percursor of the added alumina of the present silica-alumina, alumina-containing catalyst support can be prepared by various methods known in the art. Separate preparation of the hydrous alumina may be, for example, by precipitation of alumina at alkaline pH by mixing alum with sodium aluminate in aqueous solutions or with a base such as soda ash, ammonia, etc. The solution from which the hydrous alumina is precipitated may contain a concentration of about 5% to about 20% by weight of the aluminum salt. Ammonia, or more preferably ammonia water, or other aqueous base, can be added to the solution until the desired amount of alumina hydrate gel is precipitated.

Preferably, at the end of precipitation, the slurry is so thick that it just barely can be stirred. After formation of the alumina hydrogel is complete, it may be filtered or decanted prior to its combination with the silica-alumina. The alumina hydrogel filter cake may be water washed to remove part or most of its ion content, e.g., sulfate and sodium ion present in the gel, but preferably this step is omitted. Thereafter, the alumina hydrogel is ready for mixing with the silica-alumina material, for example, silica-alumina hydrogel, and the combined hydrogel slurry is stirred continuously until a uniform mixture is obtained, usually about 30 to about 60 minutes stirring time is sufficient. The aqueous hydrous alumina-silica-alumina slurry may then be washed and concentrated as by settling and the aqueous material filtered off after which the catalyst precursor is thoroughly washed to remove interferring ions, especially, sodium and sulfate ions. The final hydrocracking catalyst support preferably contains less than about 0.5% by weight sulfate.

The hydrous alumina precursor may be prepared in the presence of the silica-alumina component of the second hydrocracking catalyst support. In this procedure, the hydrated gel is preferably formed by reacting an aqueous solution of an aluminum salt of a strong inorganic acid, usually aluminum sulfate, with a base preferably ammonia water, at a pH which may vary within the range of about 5 to about 9, preferably substantially all of the alumina is precipitated at a pH of about 7 to about 7.5. Precipitation of alumina from an aqueous solution of an alkali aluminate by addition of an acid may also be employed. Also, the hydrous alumina may be precipitated by hydrolysis from alcohol solutions of aluminum alkoxides although the use of inorganic salts is preferred.

One particularly preferred method for preparing this precursor hydrous alumina is by the conventional acid hydrolysis of finely divided aluminum. In this manner, the dispersion or slurry of hydrous alumina prepared by this method can contain amorphous alumina as well as boehmite.

In the acid hydrolysis process, aluminum, preferably in a state of extremely fine subdivision and high surface area, is contacted with water, preferably at a temperature near the boiling point of water, in the presence of a non-oxidizing acid. The reaction produces a fine particle hydrous alumina slurry in water, the hydrous alumina comprising either boehmite or both of the valuable boehmite and amorphous forms.

Once the aqueous hydrous alumina-silica-alumina slurry is obtained, particles of the presently useful hydrocracking catalyst support may be formed, washed, dried and calcined using methods well known in the art. It may be necessary to adjust the free water concentration of the above-noted slurry depending on how the catalyst support particles are to be formed. Tabletting, for example, generally requires a dryer mix than does extruding, which usually calls for a free water content of about 20% to about 40% by weight. Therefore, the slurry may be partially dried. The temperature at which the drying is performed is not critical but it is generally preferred to operate at temperatures up to about 400° F. It may be—because of the type of equipment employed, or for whatever reason—that it is preferable to dry the slurry completely, or relatively so, and then add back sufficient water to obtain a formable, e.g., extrudable, coagulable (for spheridizing) etc., mix. In many instances, for example, when the final catalyst is to be in the form of extrudates, tablets, pills and the like, the slurry may be dried, for example, by spray-drying, to form microspherical particles which can be impregnated with the Group VIb and/or Group VIII metal using methods well known in the art. This impregnated material may be formed, dried and calcined using conventional methods to produce the second hydrocracking catalyst useful in the present invention. Also, the catalytically-active metals may be added after the support is formed, washed, dried and calcined and when the catalyst is to be in the form of spheres produced by the oil drop method, this procedure is preferred.

The formed particles are calcined at temperatures sufficient to effect the release of water of hydration from the particles and to provide a catalytically active alumina. Generally suitable are temperatures of about 600° F. to about 1350° F., preferably about 800° F. to about 1150° F. The calcination can be effected in an oxidizing, reducing or inert atmosphere, the more economical use of a dry air calcining atomsphere being preferred. It is usually advantageous to calcine in a flowing stream of the gaseous atmosphere. Pressure can be atmospheric, super-atmospheric or sub-atmospheric. Preferably, the final catalyst has a surface area of at least about 140 $m.^2/gm$.

When the above-noted commercially available silica-alumina particles are to be used in combination with hydrous alumina to form generally spherical catalyst supports, it is preferred that the silica-alumina particles be added in more or less dry conditions, e.g., either dried-milled or dried, wet-milled, to the hydrous alumina product to prevent further dilution of the slurry. The mixture of silica-alumina and alumina is fed to a spheridizing column to form the generally spherical support. The spheres can be, for example, up to about $\frac{1}{8}$ inch in diameter, often about 1/64 inch in diameter. The spheres may be prepared by the oil-drop method, for example, as disclosed in U.S. Pat. No. 3,558,508.

After calcination, the silica-alumina, alumina-containing catalyst support particles, e.g., spheres, may be impregnated with the catalytic metals, e.g., Group VIb and Group VIII iron group metals. These metals can be present in the final catalyst either as the free metals or in combined form such as the oxides and sulfides. Especially preferred catalysts contain nickel together with tungsten oxide or sulfide and/or molybdenum oxide or sulfide.

The impregnation can be carried out as is known in the art. The metal is peferably in solution as a compound which is a precursor of the form, e.g., free metal, metal oxide or metal sulfide, desired in the catalyst. For example, to prepare a catalyst containig nickel and molybdenum oxides, a solution of nickel nitrate and ammonium molybdate in ammonia and water can be used as the impregnating solution. The impregnated support can then be dried, as, for example, at a temperature of about 200° F. to about 270° F. for a time such as 15 to 20 hours, and then calcined in flowing air at a temperature of about 900° F. to about 1000° F. for about 2 hours to about 4 hours. Alternatively, ammonium molybdate can be dissolved in a solution of aqueous ammonia, prepared by admixing 29% ammonia and water in a ratio of 1.76:1, with nickel nitrate then being added to this solution to form a nickel-amine complex. This complex solution can then be used as the impregnant with the impregnated support being dried and calcined as before. The impregnation of the support with the catalytic metal solutions can also be performed sequentially, for example, impregnation with a solution of ammonium molybdate in ammonia followed by drying and calcination of the particles and then impregnation of the molybdenum-oxide containing support with a solution of nickel nitrate followed by another drying and calcination. Alternatively, the support may be impregnated with the nickel salt first.

The impregnated support can be reduced in hydrogen, as by heating the support in a stream of hydogen at a temperature of about 400° F. to about 1000° F., preferably about 500° F. to about 800° F. To convert the metal and/or metal oxides in the catalyst to the sulfides, the support containing the metals in oxide form as obtained from the calcination may be sulfided using conventional techniques, e.g., by passing hydrogen sulfide and/or a precursor thereof, either pure or diluted with another fluid, such as, for instance, hydrogen, over the catalyst bed at temperatures usually below about 800° F. preferably about 400° F. to about 600° F., for a time sufficient to convert a major portion of the oxides of the metal components to their respective sulfides.

The hydrocracking step of the present invention is carried out under conditions designed to selectively crack the feed so that opening of aromatic and naphthenic rings is favored, rather than the splitting of chains into lower molecular weight compounds. For example, in the production of 90–100 VI oils by the method of this invention, cracking may take place to the extent that from about 5 to 10 percent by volume of the product of the hydrocracking stage is material boiling below about 600° F. In the production of 120 VI oils, about 30 to about 50 percent by volume of the product of the hydrocracking stage may be comprised of such materials. Such hydrocracking conditions preferably include a temperature of about 700° to 875° F., more preferably about 750° F. to 850° F. The other reaction conditions preferably include a hydrogen partial pressure of about 1,000 to 5,000 p.s.i.g., more preferably about 1,500 to 3,000 p.s.i.g. The amount of free hydrogen employed during hydrocracking is preferably about 1,000 to 5,000 standard cubic feet per barrel of hydrocarbon feed, more preferably about 1,500 to 3,000 standard cubic feet per barrel. The weight hourly space velocity (WHSV), weight units of feed introduced into the reaction zone per weight unit of catalyst per hour, is preferably in the range of about 0.3 to 3, more preferably about 0.5 to 2.

The reactor effluent from the first or hydrocracking stage can be flashed to prevent hydrogen sulfide and ammonia from going to the hydrogenation stage. Also, if desired, any light hydrocarbons can be removed from the feed to the hydrogenation stage. This feed may also be dewaxed although this operation is preferably conducted after the next succeeding catalytic treatment.

The lubricating oil component from the hydrocracking stage is then subjected to a hydrogenation operation which involves contacting lubricating oil, preferably the essentially full range lube oil, from the hydrocracking stage in the presence of hydrogen with a solid hydrogenation catalyst preferably at a temperature of about 450° to 725° F., more preferably about 525° to 600° F. It is preferred that the temperature employed in the second stage be at least about 50° F. less than the temperature of the first stage for optimum decolorization and saturation. The other reaction conditions preferably include pressures of about 1,000 to 5,000 p.s.i.g., more preferably about 1,500 to 3,000 p.s.i.g.; space velocities (WHSV) of about 0.2 to 5, more preferably about 0.3 to 3; and molecular hydrogen to feed ratios of about 500 to 3,500 s.c.f./b., more preferably about 1,500 to 2,500 s.c.f./b.

The solid catalyst employed in the hydrogenation operation is preferably a sulfur-resistant, nonprecious metal hydrogenation catalyst, such as those conventionally employed in the hydrogenation of heavy petroleum oils. Examples of suitable catalytic ingredients are Group VIb metals, such as molybdenum, tungsten and/or chromium, and Group VIII metals of the iron groups, such as cobalt and nickel. These metals are present in minor, catalytically effective amounts, for instances, about 1 to 30 weight % of the catalyst, and may be present in the elemental form or in combined form such as the oxides or sulfides, the sulfide form being preferred. Mixtures of these metals or compounds of two or more of the oxides or sulfides can be employed. Examples of such mixtures or compounds are mixtures of nickel and/or cobalt oxides with molybdenum oxide. These catalytic ingredients are generally employed while disposed upon a suitable carrier of the solid oxide refractory types, e.g., a predominantly calcined or activated alumina. To avoid undue cracking, the catalyst base and other components have little, if any, hydrocarbon cracking activity. Preferably less than about 5 volume %, more preferably less than about 2 volume %, of the feed is cracked in the second or hydrogenation stage to produce materials boiling below about 600° F. Commonly employed catalysts often have about 1 to about 10, preferably about 2 to about 10, weight % of an iron group metal and about 5 to about 30 weight %, preferably about 10 to 25 weight %, of a Group VIb metal (calculated as oxide). Advantageously, the catalyst comprises nickel or cobalt, together with molybdenum supported on alumina. Such preferred catalysts can be prepared by the method described in U.S. Pat. No. 2,938,002.

After the hydrogenation step, the reactor effluent may be flashed to recover hydrogen for possible recycle and then stripped with steam or topped to remove light hydrogenated components. The degree of stripping or topping desired will depend on the particular lubricating oil fraction being processed and the particular contacting conditions employed. Thus, the amount of overhead that may be taken off may often vary from about 0 to about 50 vol. %. The resulting lubricating oil product can then be fractionated, as desired, and dewaxed. The dewaxing step can be carried out, for example, by pressing or by solvent crystallization employing methyl ethyl ketone and toluene or other suitable solvent system. The finished lubricating oil may then be sent to storage or to further processing to afford a white oil.

At least a portion of the hydrogenated oil or finished lubricating oil from the second contacting step is subjected to a third, or selective hydrogenation catalytic step. This third contacting preferably occurs at a temperature from about 450° F. to about 650° F., and still more preferably from about 450° F. to about 600° F. This latter contacting step preferably occurs at a pressure in the range from about 1000 p.s.i.g. to about 5,000 p.s.i.g., more preferably from about 2,000 p.s.i.g. to about 3,000 p.s.i.g.; at a WHSV from about 0.1 to about 1.0, more preferably from about 0.25 to about 1.0; and at a hydrogen to hydrogenated oil ratio within the range from bout 500 s.c.f./b. to about 5,000 s.c.f./b., more preferably from about 1,500 s.c.f./b. to about 5,000 s.c.f./b.

The selective hydrogenation catalyst of the present invention comprises a major amount of a support; a catalytically effective amount of at least one Group VIII platinum group metal, preferably palladium and/or platinum, and optionally, a minor amount of at least one halogen component present in an amount sufficient to improve the hydrogenation activity of the catalyst. This selective hydrogenation catalyst is not normally considered to be sulfur-resistant.

The platinum group metal component of this second catalyst may be present as the elemental metal or as a sulfide, oxide or other combined form. Preferably, the platinum group metal component comprises from about 0.1% to about 5.0%, by weight of the catalyst, calculated as the elemental metal.

The preferred support for the selective hydrogenation catalyst comprises a major amount of calcined, or otherwise activated, alumina. It is preferred that the alumina have a surface area of from about 25 $m.^2/gm.$ to about 600 $m.^2/gm.$ or more. The alumina may be derived from hydrous alumina predominating in alumina trihydrate, alumina monohydrate, amorphous hydrous alumina and mixtures thereof, which alumina when formed as pellets and calcined, has an apparent bulk density of from about 0.60 g./cc. to about 0.85 gm./cc., pore volume from about 0.45 ml./gm. to about 0.70 ml./gm., and surface area from about 50 $m.^2/gm.$ to about 600 $m.^2/gm.$ The alumina supports may contain, in addition, minor proportions of other well-known refractory inorganic oxides such as silica, zirconia, magnesia and the like. However, the preferred support is substantially pure alumina derived from hydrous alumina predominating in alumina monohydrate, amorphous hydrous alumina and mixtures thereof. More preferably, the alumina is derived from hydrous alumina predominating in alumina monohydrate.

The alumina support may be synthetically prepared in any suitable manner and may be activated prior to use by one or more treatments including drying, calcination, steaming and the like. For example, calcination often occurs by contacting the support at a temperature in the range from about 700° F. to about 1500° F., preferably from about 850° F. to about 1300° F., for a period of time from about one hour to about 20 hours, preferably from about one hour to about five hours. Thus, for instance, hydrated alumina in the form of a hydrogel can be precipitated from an aqueous solution of a soluble aluminum salt such as aluminum chloride. Ammonium hydroxide is a useful agent for effecting the precipitation. Control of the pH to maintain it within the values of about 7 to about 10 during the precipitation is desirable for obtaining a good rate of conversion. Extraneous ions, such as halide ions, which are introduced in preparing the hydrogel, can, if desired, be removed by filtering the alumina hydrogel from its mother liquor and washing the filter cake with water. Also, if desired, the hydrogel can be aged, say for a period of several days to build up the concentration of alumina trihydrate in the hydrogel.

An optional constituent of the selective hydrogenation catalyst is a halogen component. Although the precise chemistry of the association of the halogen component with the support, e.g., alumina, is not entirely known, the halogen component may be referred to as being combined with the alumina support or with the other ingredients of the catalyst. This combined halogen may be fluorine, chlorine, bromine, and mixtures thereof. Of these, fluorine and, particularly, chlorine are preferred for the purposes of the present invention. The halogen may be added to the alumina support in any suitable manner, either during preparation of the support, or before or after the addition of the noble metal component. For example, at least a portion of the halogen may be added at any stage of the preparation of the support, or to the calcined catalyst support, as an aqueous solution of an acid such as hydrogen fluoride, hydrogen chloride, hydrogen bromide and the like or as a substantially anhydrous gaseous stream of these halogen-containing components. The halogen component, or a portion thereof, may be composited with alumina during the impregnation of the latter with the palladium or platinum component, for example, through the utilization of a mixture of chloropalladic acid or chloraplatinic acid and hydrogen chloride. When the catalyst is prepared by impregnating calcined, formed alumina, for example, spheres, it is preferred to impregnate the support simultaneously with the metal and halogen. In any event, the halogen will be added in such a manner as to result in a fully composited catalyst that preferably contains from about 0.1% to about 4.0%, and more preferably from about 0.6% to about 2.5%, by weight of halogen calculated on an elemental basis. During processing, i.e., the period during which hydrogenated oil in the presence of hydrogen is being contacted with the selective hydrogenation catalyst, the halogen content of the catalyst can be maintained at or restored to the desired level by the addition of halogen-containing compounds, such as carbon tetrachloride, ethyl trichloride, t-butyl chloride and the like, to the hydrogenated oil before such contacting.

As indicated above, the selective hydrogenation catalyst of the present invention contains at least one platinum group metal component.

The platinum group metal component may be incorporated in the catalyst in any suitable manner well known in the art, such as by coprecipitation or cogellation with the alumina support, ion-exchange with the alumina support and/or alumina hydrogel, or by the impregnation of the alumina support calcination of the alumina hydrogel. One preferred method for adding the metal component to the alumina support involves the utilization of a water soluble compound of the platinum group metal to impregnate the alumina support after calcination. For example, palladium may be added to the support by comingling the calcined alumina with an aqueous solution of chloropalladic acid. Other water-soluble compounds of palladium may be employed as impregnation solutions, including, for example, ammonium chloropalladate and palladium chloride. The utilization of a palladium-chlorine compound, such as chloropalladic acid, is preferred since it facilitates the incorporation of both the palladium component and at least a minor quantity of the halogen component. The corresponding acids and/or salts of the other platinum group metal, e.g., platinum, may be similarly added. Following this impregnation, the resulting impregnated support is dried and may be subjected to a high temperature calcination or oxidation procedure at a temperature in the range from about 700° F. to about 1500° F., preferably from about 850° F. to about 1300° F., for a period of time from about one hour to about 20 hours, preferably from about one hour to about five hours. When dried, the major portion of the halogen component may be added to this otherwise fully composited catalyst by contacting this catalyst with a subsstantially anhydrous stream of halogen-containing gas.

If desired, the selective hydrogenation catalyst can be hydrogen purged and/or prereduced prior to use by heating in the presence of hydrogen, for example, at temperature of about 300° F. to 600° F. for purging and of about 600° F. to 1200° F. for prereducing. By prereduction is meant the chemical reaction, i.e., reduction in oxidation state, of at least a portion of the metallic component of the catalyst. Prereduction may be achieved by contacting the catalyst with hydrogen for a period of time of at least about one-half (½) hour, preferably from about 0.5 hour to about 10 hours and at a pressure of from about 0 p.s.i.g. to about 500 p.s.i.g.

The catalysts employed in this invention are preferably disposed in the reaction zones as fixed beds. Such fixed bed catalysts may be formed into macrosize particles of any desired shape such as pills, tablets, extrudates, granules, spheres, and the like, using conventional methods. The preferred size for the catalyst particles will generally be within the range from about 1/64 to about ¼ inch, preferably from about 1/16 to about ⅛ inch, in diameter, and from about 1/16 to about ½ inch, in length. Spherical particles having a diameter of about 1/16 to about ⅛ inch are often useful in fixed bed reactor systems.

After the selective hydrogenation step, the white oil product may be topped as required and sent to storage.

In this sequence of catalytic steps, the second, or hydrogenation step, effectively reduces the content of aromatic hydrocarbons in the lubricating oil fraction to a very low level, preferably, less than about 2 wt. %, and more preferably less than about 1 wt. %. Although the product of this second step comprises a suitably high VI lubricating base oil, the third, or selective hydrogenation step, further reduces the level of undesirable components to below the level required for a food grade white oil, as measured by ultra-violet absorbance at selected wave lengths.

Although this catalytic process very conveniently and effectively affords food grade white oils of any suitable viscosity range, it is particularly effective in the production of high VI oils without excessive loss of viscosity. White oils having viscosities in excess of about 500 SUS at 100° F. are advantageously produced by the process of the present invention. The oil feedstocks may have a viscosity within the range from about 50 to about 7500 SUS at 100° F. Preferably the feedstock will have a viscosity within the range from about 400 to about 5000 SUS at 100° F.

The following data are examplary, without limitation, of the process of this invention:

A waxy virgin gas oil having the feedstock properties set forth in Table I was hydrocracked at 775° F., and 0.5 WHSV, 2750 p.s.i.g., and 2500 s.c.f./b. hydrogen over a nickel-molybdenum-on-alumina silica-alumina catalyst containing 7 wt. % nickel and 24 wt. % molydenum, on an oxide basis, together with substantially equal weight portions of silica and alumina. The properties of a dewaxed sample of the hydrocracking lubricating oil stock were as set forth in Table I for Step 1.

The hydrocracked product was first stripped of ammonia and hydrogen sulfide and then hydrogenated over a commercial nickel-molybdenum (2.5 wt.% nickel-15 wt. % molybdenum, on an oxide basis) on alumina catalyst at 650° F., 0.3 WHSV, 2500 p.s.i.g., and 2500 s.c.f./b. hydrogen. The resulting high VI lubricating base oil after dewaxing, had the properties set forth in Table I for Step 2.

The dewaxed product of Step 2 was then subjected to a selective hydrogenation over a chlorided platinum-alumina catalyst, which in its virgin state contained 0.6 wt. % platinum and 1 wt. %. chlorine. The contacting occurred at 500° F., 0.16 WHSV, 2500 p.s.i.g., and 2500 s.c.f./b. hydrogen. The resulting white oil, after stripping, had the properties set forth in Table I for Step 3, substantially exceeding the minimum specification requirements for food grade mineral oil.

When a similar sample of waxy virgin gas oil is hydrocracked at 775° F., and 0.5 WHSV, 2750 p.s.i.g., and 2500 s.c.f./b. hydrogen over a nickel-molybdenum-boria-alumina catalyst, containing 2.3 wt. % nickel, 15.6 wt. % molybdenum, on an oxide basis, and 5.0 wt. % boria, substantially similar properties are found in the hydrocracked lubricating oil stock. Further hydrogenation and selective hydrogenation processing, as above, similarly yields a good grade mineral oil.

While this invention has been described with respect to various specific examples and embodiment, it is to be understood that the invention is not limited thereto and that it can be variously practiced within the scope of the following claims:

TABLE I

| | | Product | | |
|---|---|---|---|---|
| | Feedstock | Step 1[a] | Step 2[a] | Step 3 |
| Gravity, ° API | 21.4 | 33.9 | 33.8 | 33.9 |
| Pour Point, °F. | 110 | 5 | 0 | |
| Viscosity Index | 42 | 115 | 117 | |
| Viscosity, SUS at 100° F. | — | | | |
| Aromatics, wt. % | 49.1 | 10 | 1.0 | |
| Sulfur, wt. % | 1.80 | 0.002 | <0.001 | |
| Hydrogen, wt. % | 12.13 | 13.87 | 14.02 | |
| Nitrogen, ppm. | 1380 | 2 | 1 | |
| Color, ASTM | | <1.5 | <0.5 | 30+ Saybol |
| Distillation, ASTM | | °F. | | |
| IBP/5% | 626/751 | 540/586 | 432/511 | |
| 10/20 | 765/781 | 614/664 | 631/669 | |
| 30/40 | 802/817 | 708/743 | 708/748 | |
| 50/60 | 834/853 | 774/802 | 772/793 | |
| 70/80 | 874/897 | 833/873 | 819/844 | |
| 90/95 | 936/955 | 919/955 | 893/927 | |
| Fraction of Waxy Feed, wt. % | 100 | 59.2 | 58.5 | 58.0 |
| UV Absorbance, per centimeter optical pathlength at | | | | |
| 260–350 mmu | | | 11.7 | 0.030[b] |
| 280–290 mmu | | | 6.26 | 0.030 |

TABLE I-continued

| | Feedstock | Product Step 1[a] | Product Step 2[a] | Product Step 3 |
|---|---|---|---|---|
| 290–300 mmu | | | 7.20 | 0.023 |
| 300–330 mmu | | | 11.7 | 0.020 |
| 330–350 mmu | | | 3.41 | 0.010 |

[a]Dewaxed.

[b]Maximum allowable value is 0.1 for food grade white oil.

What is claimed is:

1. A process for preparing a food grade white mineral oil from a mineral hydrocarbon oil feedstock of lubricating oil viscosity, comprising the steps of:

(a) contacting the mineral hydrocarbon oil feedstock with molecular hydrogen under hydrocracking conditions, in the presence of a hydrocracking catalyst to form a hydrocracked oil having increased viscosity index relative to said feedstock;

(b) contacting product hydrocracked oil of lubricating oil viscosity from step (a) with molecular hydrogen under hydrogenation conditions to avoid undue cracking in the presence of a sulfur-resistant, non-precious metal hydrogenation catalyst; and (c) contacting product hydrocarbon oil of lubricating oil viscosity from step (b) with molecular hydrogen under selective hydrogenation conditions in the presence of a selective hydrogenation catalyst.

2. The process of claim 1 wherein the hydrocarbon oil feedstock has a viscosity index within the range from about 10 to about 80, and wherein at least about 90 wt. % of said feedstock boils above about 600° F.

3. The process of claim 1 wherein the product hydrocarbon oil from step (b) is dewaxed prior to the selective hydrogenation step.

4. The process of claim 1 wherein the white mineral oil product has a viscosity of at least about 50 SUS at 100° F.

5. A process for preparing a food grade white mineral oil from a mineral hydrocarbon oil feedstock of lubricating oil viscosity, comprising the steps of:

(a) contacting the mineral hydrocarbon oil feedstock with molecular hydrogen under hydrocracking conditions, in the presence of a catalyst comprising catalytically effective amounts of each of at least one Group VIII iron group metal; at least one Group VIb metal and mixtures thereof; and a supporting comprising active alumina to form hydrocracked oil having increased viscosity index relative to said feedstock;

(b) contacting product hydrocracked oil of lubricating oil viscosity from step (a) with molecular hydrogen under hydrogenation conditions to avoid undue cracking in the presence of a sulfur-resistant, non-precisous metal catalyst comprising catalytically effective amounts of each of at least one Group VIII iron group metal, and at least one Group VIb metal on an alumina support; and (c) contacting product hydrocarbon oil of lubricating oil viscosity from step (b) with molecular hydrogen under selective hydrogenation conditions in the presence of a catalyst comprising a catalytically effective amount of at least one member selected from the class consisting of Group VIII noble metals, and mixtures thereof, together with an alumina support.

6. The process of claim 5 wherein the hydrocracking catalyst support comprises boria together with an active alumina.

7. The process of claim 5 wherein the hydrocracking catalyst support comprises silica-alumina together with an active alumina.

8. The process of claim 5 wherein the selective hydrogenation catalyst additionally contains a halogen component.

9. The process of claim 5 wherein the hydrocarbon oil feedstock has a viscosity index within the range from about 10 to about 80, and wherein at least about 90 wt. % of said feedstock boils above about 600° F.

10. The process of claim 5 wherein the hydrocracking conditions include a temperature within the range from about 700° F. to about 875° F., a hydrogen partial pressure within the range from about 1,000 to about 5,000 p.s.i.g., a weight hourly space velocity within the range from about 0.3 to about 3.0, and a hydrogen to hydrocarbon feed ratio within the range from 1,000 to about 5,000 s.c.f./b. of feed.

11. The process of claim 5 wherein the hydrogenation conditions of step (b) include a temperature within the range from about 450° F., a hydrogen partial pressure within the range from about 1,000 to about 5,000 p.s.i.g., a weight hourly space velocity within the range from about 0.2 to about 5.0, and a hydrogen to hydrocarbon feed ratio within the range from about 500 to about 3,500 s.c.f./b. of feed.

12. The process of claim 5 wherein the selective hydrogenation conditions of step (c) include a temperature within the range from about 450° F. to about 650° F., a hydrogen partial pressure within the range from about 1,000 to about 5,000 p.s.i.g., a weight hourly space velocity within the range from about 0.1 to about 1.0, and a hydrogen to hydrocarbon feed ratio within the range from about 500 to about 5,000 s.c.f./b. of feed.

13. The process of claim 5 wherein the hydrocracking catalyst comprises from about 1 to about 15 wt. % nickel and from about 5 to about 30 wt. % of a member selected from the class consisting of tungsten, molybdenum, and mixxtures thereof, on an oxide basis on a silica-alumina-amorphous silica support.

14. The process of claim 5 wherein the hydrocracking catalyst comprises from about 1 to about 15 wt. % nickel and from about 5 to about 30 wt. % of a member selected from the class consisting of tungsten, molybdenum, and mixtures thereof, on an oxide basis, on a boria-amorphous alumina support including from about 2 to about 10 wt. % boria.

15. The process of claim 5 wherein the hydrocracking catalyst is in the sulfide form.

16. The process of claim 5 wherein the hydrogenation catalyst of step (b) comprises from about 1 to about 10 wt. % of a member selected from the class consisting of cobalt, nickel, and mixtures thereof, and from about 5 to about 30 wt. % molybdenum, on an oxide basis.

17. The process of claim 16 wherein the hydrogenation catalyst is in the sulfide form.

18. The process of claim 5 wherein the selective hydrogenation catalyst comprises from about 0.1 to about 5.0 wt. % of a member selected from the class consisting of palladium, platinum, and mixtures thereof.

19. The process of claim 18 wherein the selective hydrogenation catalyst additionally comprises from about 0.1 to about 4.0 wt. % of a halogen component.

20. The process of claim 5 wherein the effluent oil from the hydrocracking step is fractionated to separate an oil of lubricating oil viscosity and the lubricating oil fraction is dewaxed.

21. The process of claim 5 wherein the effluent oil from the hydrogenation step is fractionated to separate oil of lubricating oil viscosity and the lubricating oil fraction is dewaxed.

22. The process of claim 5 wherein the food grade white oil product has a viscosity of at least about 50 SUS at 100° F.

23. The process of claim 5 wherein the food grade white oil product has a viscosity within the range from about 50 to about 500 SUS at 100° F.

24. The process of claim 5 wherein the food grade white oil product has a viscosity of at least about 500 SUS at 100° F.

25. The process of claim 13 wherein the silica-alumina component of the support material contains from about 40 to about 92 wt. % silica.

26. The process of claim 25 wherein the silica-alumina component of the support material contains about 87 wt. % silica.

27. The process of claim 13 wherein the support material comprises from about 40 wt. % to about 60 wt. % silica and from about 60 wt. % to about 40 wt. % alumina.

28. The process of claim 27 wherein the support material comprises substantially equal weight portions of silica and alumina.

* * * * *